US007642991B2

(12) United States Patent
Hashimoto et al.

(10) Patent No.: US 7,642,991 B2
(45) Date of Patent: Jan. 5, 2010

(54) METHOD FOR DRIVING PLASMA DISPLAY PANEL

(75) Inventors: Yasunobu Hashimoto, Kawasaki (JP); Tadayoshi Kosaka, Kawasaki (JP); Yoshiho Seo, Kawasaki (JP); Naoki Itokawa, Kawasaki (JP); Hajime Inoue, Kawasaki (JP); Kazushige Takagi, Kawasaki (JP); Katsuya Irie, Kawasaki (JP)

(73) Assignee: Hitachi Plasma Patent Licensing Co., Inc., Tokyo (JP)

( * ) Notice: Subject to any disclaimer, the term of this patent is extended or adjusted under 35 U.S.C. 154(b) by 1013 days.

(21) Appl. No.: 10/869,852

(22) Filed: Jun. 18, 2004

(65) Prior Publication Data

US 2005/0156821 A1 Jul. 21, 2005

(30) Foreign Application Priority Data

Jan. 16, 2004 (JP) ..... 2004-009577

(51) Int. Cl.
*G09G 3/28* (2006.01)

(52) U.S. Cl. ..... 345/60; 345/67

(58) Field of Classification Search ..... 345/60–72; 315/169.4; 313/581–587
See application file for complete search history.

(56) References Cited

U.S. PATENT DOCUMENTS

| | | | | |
|---|---|---|---|---|
| 6,031,329 | A * | 2/2000 | Nagano | 313/582 |
| 6,456,263 | B1 | 9/2002 | Hashimoto et al. | |
| 6,465,970 | B2 | 10/2002 | Nagakubo et al. | |
| 6,476,801 | B2 | 11/2002 | Nagai | |
| 6,489,727 | B2 | 12/2002 | Kanazawa | |
| 6,608,609 | B1 | 8/2003 | Setoguchi et al. | |
| 6,724,357 | B2 * | 4/2004 | Kim et al. | 345/60 |
| 2002/0012075 | A1 | 1/2002 | Nagakubo et al. | |
| 2002/0130823 | A1 | 9/2002 | Takayama | |

FOREIGN PATENT DOCUMENTS

| | | |
|---|---|---|
| EP | 1 003 149 | 5/2000 |
| EP | 1 199 701 A | 4/2002 |
| JP | 03 219286 | 9/1991 |
| JP | 4-280289 | 10/1992 |
| JP | 8-160910 | 6/1996 |
| JP | 10-274961 | 10/1998 |
| JP | 10-333636 | 12/1998 |
| JP | 11-352924 | 12/1999 |
| JP | 2000-20021 | 1/2000 |
| JP | 2000-227780 | 8/2000 |
| JP | 2000-231361 | 8/2000 |
| JP | 2001-337646 | 12/2001 |
| JP | 2001-350447 | 12/2001 |

(Continued)

OTHER PUBLICATIONS

U.S. Appl. No. 12/285,231, filed Sep. 30, 2008, Yasunobu Hashimoto et al, Hitachi, LTD. Tokyo, Japan.

(Continued)

*Primary Examiner*—Jimmy H Nguyen
(74) *Attorney, Agent, or Firm*—Staas & Halsey

(57) ABSTRACT

A method for driving an AC type plasma display panel includes the steps of performing initialization at least once for each frame so as to clear binary setting of wall charge quantity in a screen by discharge except for micro discharge in which electrodes covered with a plurality of fluorescent materials become cathodes, and performing special initialization at frequency of once for M frames, where M=two or more, so as to erase unnecessary wall charge in the screen by discharge in which electrodes become cathodes and that is stronger than the discharge in the initialization.

1 Claim, 15 Drawing Sheets

FOREIGN PATENT DOCUMENTS

| | | |
|---|---|---|
| JP | 2002-72961 | 3/2002 |
| JP | 2002-278510 | 9/2002 |
| KR | 2000-0005734 | 1/2000 |

OTHER PUBLICATIONS

U.S. Appl. No. 12/285,235, filed Sep. 30, 2008, Yasunobu Hashimoto et al., Hitachi, LTD. Tokyo, Japan.

European Search Report issued on Oct. 27, 2008 in corresponding European Patent Application 04252997.4.

U.S. Appl. No. 12/285,231, filed Sep. 30, 2008, Yasunobu Hashimoto et al., Hitachi, Ltd. Tokyo, Japan.

U.S. Appl. No. 12/285,235, filed Sep. 30, 2008, Yasunobu Hashimoto et al., Hitachi, Ltd. Tokyo, Japan.

Japanese Office Action dated Jun. 2, 2009 and issued in corresponding Japanese Patent Application 2004-009577.

* cited by examiner

METHOD FOR DRIVING PLASMA DISPLAY PANEL

BACKGROUND OF THE INVENTION

1. Field of the Invention

The present invention relates to a method for driving a plasma display panel (PDP).

2. Description of the Prior Art

A method for driving an AC type plasma display panel utilizes wall voltage generated by charge in a dielectric that covers display electrode pairs for a display. Quantity of wall charge in cells to generate display discharge is made larger than quantity of wall charge in other cells in a screen. Binary setting of this wall charge quantity is called addressing. After the addressing, an appropriate sustain pulse (that is also called a display pulse) is applied to all cells simultaneously. By the application of the sustain pulse, drive voltage is added to wall voltage. Display discharge is generated only in cells in which a cell voltage that is the sum of the drive voltage and the wall voltage exceeds a discharge start voltage. Light emission by the display discharge is called "lighting". By utilizing the wall voltage, it is possible to light only cells to be energized selectively.

In a display of a frame, the addressing is performed at fixed intervals, and initialization is performed in each addressing. The initialization means to clear the binary setting of the wall charge quantity that is kept in the screen at the start time point thereof, namely to equalize wall charge quantity of all cells. When the initialization is finished, the wall charge quantity depends on a form of the addressing. If write form addressing is performed, wall charge quantity of all cells is set to a quantity that cannot generate discharge when the sustain pulse is applied. If an erasing form of addressing is performed, wall charge quantity of all cells is set to a quantity that can generate discharge when the sustain pulse is applied.

As methods for initialization, there are known a method of applying a rectangular waveform pulse having a width smaller than the sustain pulse, a method of applying an obtuse waveform pulse such as a ramp waveform pulse, and a method of applying a rectangular waveform pulse plus an obtuse waveform pulse. These methods generate discharge that is weaker than display discharge and have an advantage that background light emission is little. The background light emission is a phenomenon that a dark portion of an image emits light slightly. In addition, if an obtuse waveform pulse is applied, quantity of the background light emission can be reduced while fine adjustment of the wall charge quantity for compensating variation of the discharge start voltage among cells can be performed. Japanese unexamined patent publication No. 11-352924 describes in detail about the initialization that utilizes "micro discharge" generated by applying an obtuse waveform pulse.

The micro discharge is a very weak discharge responding to the application of an obtuse waveform pulse whose amplitude changes gradually and is distinguished from one-shot discharge responding to the application of a rectangular waveform pulse having sufficient amplitude. The micro discharge starts when the sum of the applied voltage and the wall voltage exceeds the discharge start voltage and lasts until the applied voltage of the obtuse waveform pulse becomes a maximum value (a final voltage) in a continuous manner or a similar intermittent manner.

The conventional driving method has some problems. One is irregularity in a display that becomes conspicuous as time passes from the start of a continuous display that lasts approximately a few hours. Another problem is that the background light emission color becomes not an achromatic color (a dark gray color) but a chromatic color (a reddish, greenish or bluish color) when the initialization by the micro discharge is performed for a color display. Concerning the problem of the background light emission color, Japanese unexamined patent publication No. 2002-278510 discloses a driving method in which amplitude of the obtuse waveform pulse is optimized for each light emission color of a cell. However, this disclosed driving method needs a complicated structure of driving circuit.

SUMMARY OF THE INVENTION

A first object of the present invention is to suppress irregularity in a display. A second object is to make a background light emission color in a screen including cells having different light emission colors an achromatic color by applying a voltage that is common to all light emission colors.

According to one aspect of the present invention, a method for driving an AC type plasma display panel includes the steps of performing initialization at least once for each frame so as to clear binary setting of wall charge quantity in the screen by discharge, and performing special initialization at frequency of once for two or more (M) frames so as to erase unnecessary wall charge in the screen by discharge that is stronger than the discharge in the initialization. Particularly in driving a plasma display panel having electrodes covered with plural types of fluorescent materials for a color display or a bicolor display, the initialization for each frame does not generate micro discharge in which the electrodes become cathodes, but the special initialization for M frames generates discharge in which the electrodes become cathodes.

In order to decrease luminance of background light emission, it is desirable to make the discharge in the initialization as weak as possible. However, noting the influence of discharge in each cell, the area that is affected by the discharge becomes smaller as the discharge becomes weaker. The irregularity in the conventional display is considered to be caused by a difference of expansion between the display discharge and the initialization discharge. Quantity of wall charge that is formed by discharge is larger at a position close to a discharge gap compared to a position far therefrom. In addition, there are more cations that make positive wall charge than electrons that make negative wall charge as a position is close to a discharge gap. It is because an electron has smaller mass than a cation. The initialization discharge is weaker than the display discharge, so the negative wall charge that reached an area far away from the discharge gap in a cell by the display discharge is not erased by the initialization. Therefore, as the display discharge is repeated, the wall charge that is not erased by the initialization is accumulated. This wall charge is called a "surplus accumulated charge". When quantity of the surplus accumulated charge exceeds a limit, address discharge becomes not generated, resulting in a lighting error. Namely, a drive margin is narrowed that is a range of permissible variation of a drive voltage for realizing correct operation of a display.

The special initialization that is unique to the present invention controls the surplus accumulated charge that is unnecessary charge. When the special initialization is performed, the surplus accumulated charge is erased. However, since discharge in the special initialization is stronger than the discharge in the initialization, the special initialization causes light emission larger than in the initialization. Therefore, in order to reduce the background light emission, it is necessary to control the special initialization in a necessary minimum level. It is desirable to change a frequency of special initialization in accordance with a change of display contents or operational environment so that the number of times of the special initialization per unit time becomes as small as possible within the range where the quantity of the surplus accumulated charge does not exceed a limit.

The problem of the background light emission color can be solved by limiting a form and a polarity of discharge in the initialization as described above. It is because that a conspicuous phenomenon of the background light emission color becoming a chromatic color appears only in the case where micro discharge is generated in which electrodes covered with fluorescent materials become cathodes. The phenomenon will be described in detail as below. An end point of the micro discharge is a trailing edge of the obtuse waveform pulse and is independent of a material of the fluorescent material. However, a start point of the micro discharge is determined by a discharge start voltage and depends on the material of the fluorescent material. It is because that the secondary electron emission coefficient is different between different types of fluorescent materials. In general, among three types of fluorescent materials that are used for a color display, the secondary electron emission coefficient decreases in the order of red, blue and green. The larger the secondary electron emission coefficient is, the lower the discharge start voltage is, so that micro discharge starts earlier. The longer the period between the start point and the end point of the micro discharge is, the more the quantity of the light emission is. Therefore, the background light emission color becomes a chromatic color that is close to a light emission color of a fluorescent material having a lot of light emission quantity.

In the special initialization, the discharge is generated in which the electrodes covered with the fluorescent materials become cathodes, so that uneven distribution of charge due to restriction of a discharge form in the initialization can be canceled. Discharge in the special initialization is preferably a single shot of discharge generated by a rectangular waveform pulse. Intensity of this type of discharge is independent of the discharge start voltage, so there is little possibility that the background light emission color becomes a problem. Even if a cell voltage when discharge starts is different between cells, the discharge intensity (variation of the wall voltage) becomes substantially the same when sufficiently high cell voltage is applied. In relatively strong discharge, large quantity of space charge is generated, and the space charge is attracted by the electrode after the end of the discharge until a voltage that is applied to the discharge space becomes substantially zero. Namely, the variation quantity of the wall voltage is substantially the same as the cell voltage at the start point of the discharge.

According to the present invention, the background light emission can be reduced, and unnecessary accumulation of wall charge that may cause irregularity of a display can be canceled.

In addition, according to the present invention, a background light emission color in a screen including cells having different light emission colors can be an achromatic color by applying a voltage that is common to all light emission colors.

DESCRIPTION OF THE PREFERRED EMBODIMENTS

Hereinafter, the present invention will be explained more in detail with reference to embodiments and drawings.

An AC type plasma display panel that is useful for a color display device and has a screen including cells having a three-electrode surface discharge structure is a suitable object for the present invention.

(Panel Structure)

Figure 1:
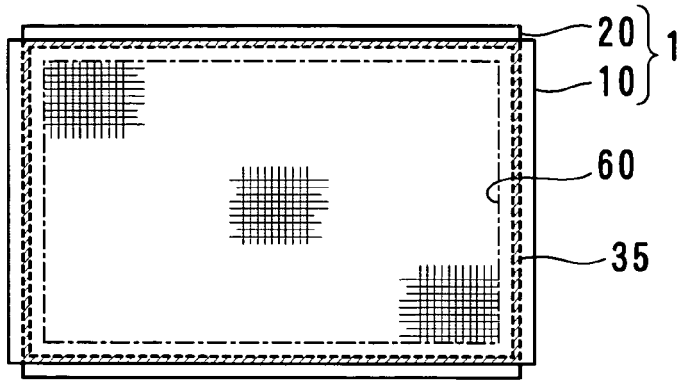
FIG. 1 is a diagram showing a general structure of an AC type plasma display panel according to an embodiment of the present invention.

FIG. 1 shows a general structure of an AC type plasma display panel according to an embodiment of the present invention. The plasma display panel 1 includes a pair of substrate structural bodies 10 and 20. The substrate structural body is a structure including a glass substrate having dimensions larger than a screen size and elements including electrodes and others on the glass substrate. The substrate structural bodies 10 and 20 are arranged to face and overlap each other, so as to be bonded to each other by a sealant 35 at periphery of the overlapped portion. Inner space that is sealed by the substrate structural bodies 10 and 20, and the sealant 35 is filled with a discharge gas. The portion inside the sealant 35 in which cells are arranged is a screen 60. The substrate structural body 10 protrudes from the substrate structural body 20 in the horizontal direction while the substrate structural body 20 protrudes from the substrate structural body 10 in the vertical direction as shown in FIG. 1. The extending edge portion is bonded to a flexible printed circuit board for electric connection to a drive unit.

Figure 2:
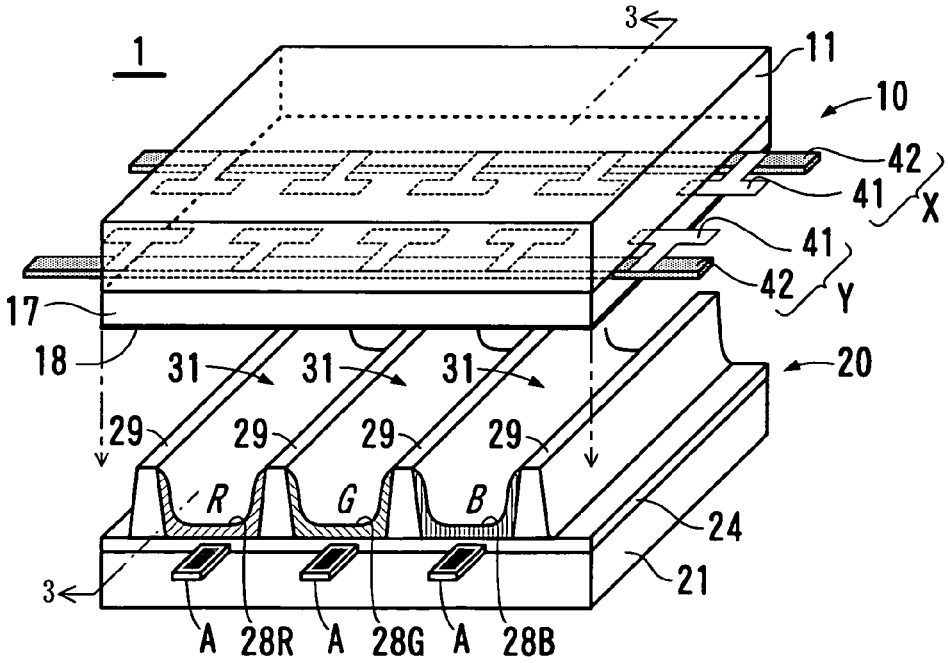
FIG. 2 is a diagram showing an example of a cell structure of the plasma display panel.

FIG. 2 shows an example of a cell structure of the plasma display panel. In FIG. 2, a portion corresponding to three cells for one pixel display in the plasma display panel 1 is shown with splitting a pair of substrate structural bodies 10 and 20 for easy understanding of an inner structure.

The plasma display panel 1 has a cell structure of a three-electrode surface discharge type. Display electrodes X and Y, a dielectric layer 17 and a protection film 18 are arranged on the inner surface of a front glass substrate 11, while address electrodes A, an insulation layer 24, partitions 29 and fluorescent material layers 28R, 28G and 28B are arranged on the inner surface of a back glass substrate 21. Each of the display electrodes X and Y includes a T-shaped transparent conductive film 41 that forms a surface discharge gap and is independent of other cells, and a band-like metal film 42 that is a bus conductor. The partitions 29 are arranged so that one of them corresponds to one electrode gap of the address electrode arrangement. These partitions 29 divide a discharge space in the row direction into columns. A column space 31 of the discharge space that corresponds to each column is continuous over all rows. The fluorescent material layers 28R, 28G and 28B are excited locally by ultraviolet rays emitted by a discharge gas and emit light. Italic alphabet letters R, G and B in FIG. 2 show light emission colors of the fluorescent materials. One type of the fluorescent material covers each of the address electrodes A, though total three types of fluorescent materials cover the entire of the address electrodes A arranged on the screen.

Figure 3:
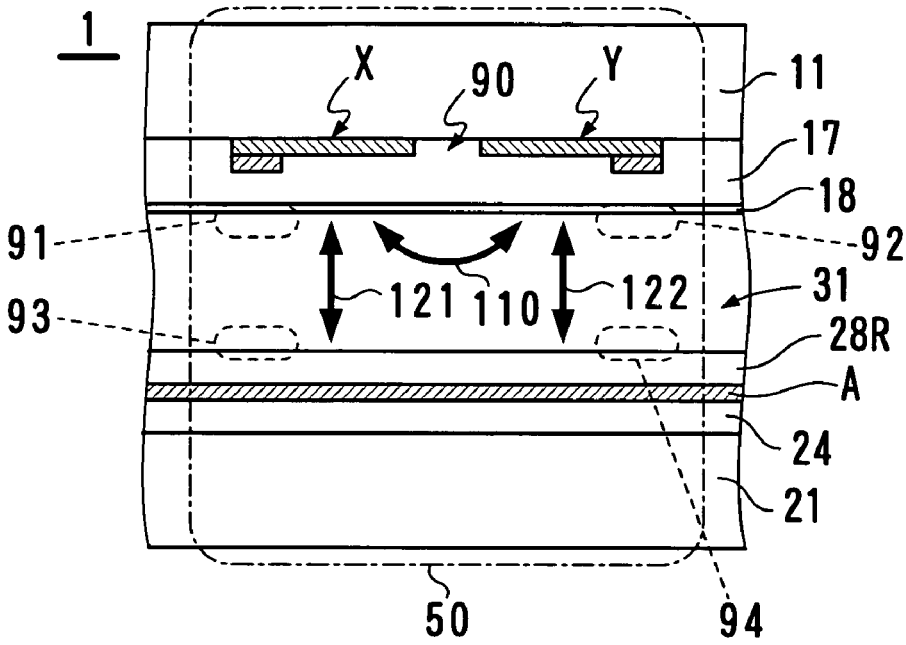
FIG. 3 is a diagram showing a cross sectional structure of a cell.

FIG. 3 shows a cross sectional structure of a cell. In a cell 50, a display electrode X and a display electrode Y that make a pair are arranged close to each other via a surface discharge gap 90. This display electrode pair and an address electrode A are opposed to each other via a column space 31. The cell 50 has an interelectrode between the display electrode X and the display electrode Y (that is called an XY-interelectrode), an interelectrode between the address electrode A and the display electrode X (that is called an AX-interelectrode), and an interelectrode between the address electrode A and the display electrode Y (that is called an AY-interelectrode). According to classification of a discharge form on the basis of an electrode arrangement, the XY-interelectrode discharge 110 is called surface discharge, while the AX-interelectrode discharge 121 and the AY-interelectrode discharge 122 are called counter discharge. When any one of the interelectrode discharge is generated, wall charge is generated in the dielectric layer 17 that covers the electrode pair and in the fluorescent material layer 28R that covers the address electrode A. The surplus accumulated charge has tendency to be accumulated in portions 91, 92, 93 and 94 in the cell 50 that are far from the surface discharge gap 90.

(Frequency of Special Initialization)

Figure 4:
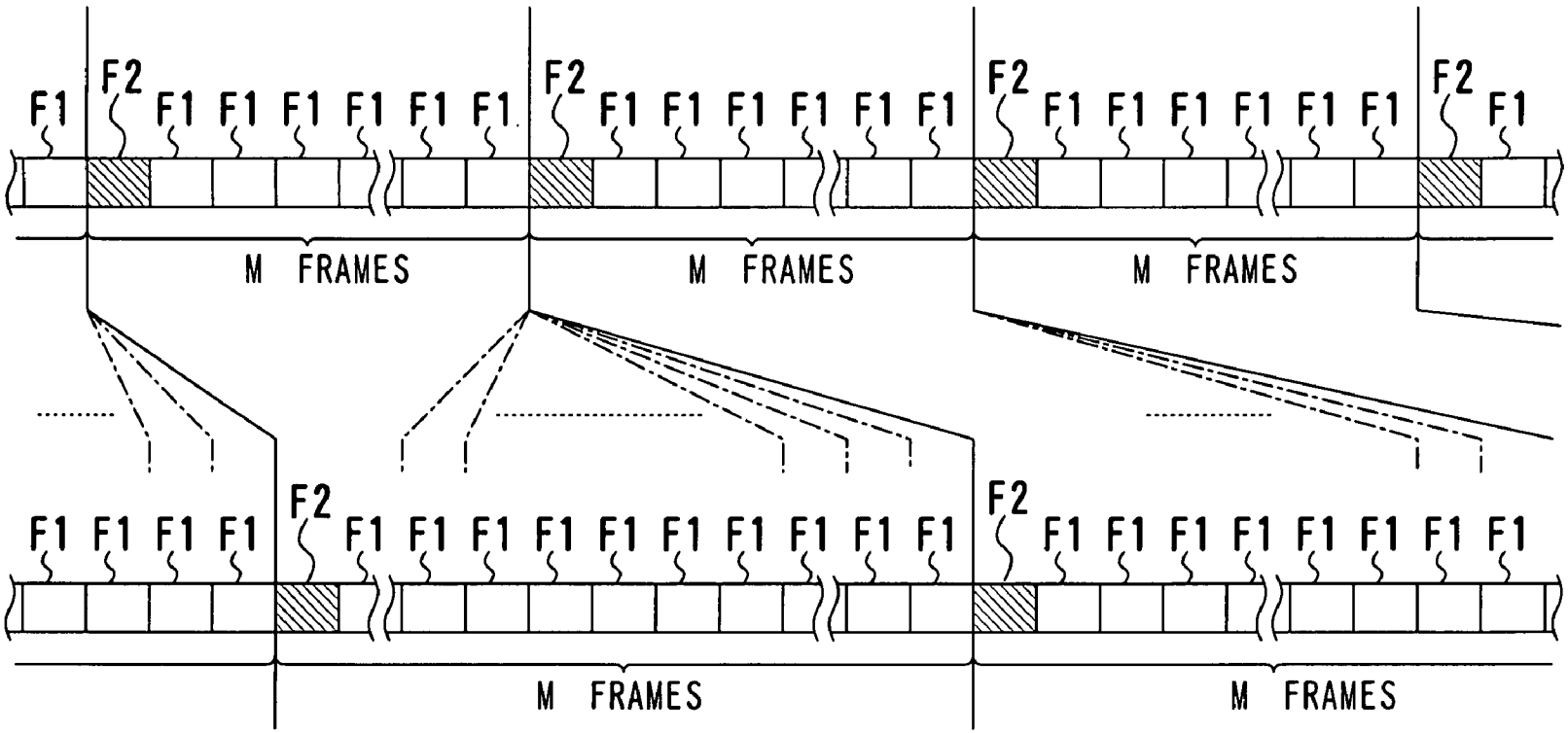
FIG. 4 is a diagram showing a structure of a frame train according to the present invention.

FIG. 4 shows a structure of a frame train according to the present invention. In a frame train that includes plural frames having sequential display orders, plural frames F2 are selected as special frames discretely at a ratio of one out of two or more (M) frames. The special frame F2 is a frame in which special initialization that is unique to the present invention is performed. Frames F1 that are not selected as the special frame F2 are called as ordinary frames for convenience. The number M of frames that corresponds to a frequency of the special initialization is not fixed but can be changed appropriately in accordance with a change of display contents or operational environment so as to control the special initialization at the necessary minimum.

Figure 5:
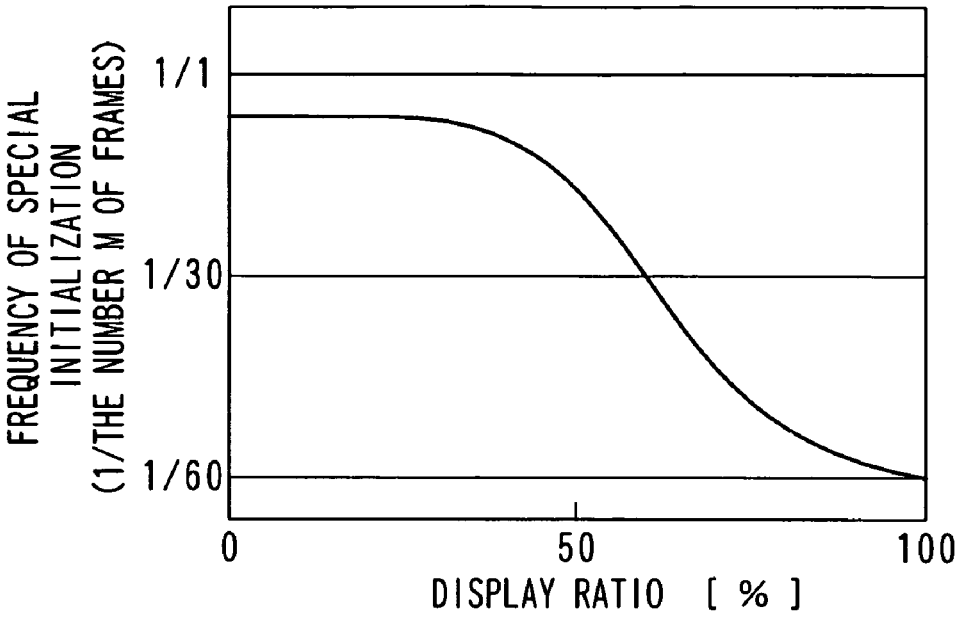
FIG. 5 is a diagram showing an example of changing a frequency of special initialization.

FIG. 5 shows an example of changing the frequency of the special initialization. In this example, the frequency of the special initialization is determined in accordance with a display ratio that is a ratio of lighting and non-lighting of the entire screen per frame. In the drive of the plasma display panel 1, the number of sustain pulses per frame is adjusted so that power consumption does not exceed a tolerance limit value when the display ratio exceeds a predetermined value. Namely, in a display of a frame that has a display ratio larger than the predetermined value, the number of sustain pulses per frame becomes smaller as the display ratio increases. The surplus accumulated charge increases as the number of sustain pulses per frame increases. Therefore, the smaller the display ratio is, the lager the necessity of the special initialization. Thus, it is effective to shorten an interval between executions of the special initialization as the display ratio is smaller.

The display ratio changes for each frame, so the number of sustain pulses in a display of one frame also changes for each frame. Therefore, it is desirable to determine the interval between executions of the special initialization in accordance with a mean value of the number of sustain pulses in plural frames or to perform the special initialization when an integrated value of the number of sustain pulses exceeds a predetermined value. When the special initialization is performed, the integrated value is reset.

In order to control the change of the number M of frames more precisely, not the number of sustain pulses but the number of light emission times in each cell is monitored, so that the interval between executions of the special initialization is shortened (the number M is increased) for larger number of light emission times with respect to the cell having a large number of light emission times. Also in this case, the number M of frames is changed in accordance with the mean value in plural frames. In addition, it is possible to monitor the integrated value of the number of light emission times for each cell, and to perform the special initialization when the number of cells in which the integrated value exceeds a certain value becomes more than a predetermined value. When the special initialization is performed, the integrated value is reset.

Instead of monitoring the number of light emission times in each cell, it is convenience to use an average luminance in a screen as an index for the control. Namely, the interval between executions of the special initialization is set to a smaller value as a mean value of the average luminance in plural frames is larger. Alternatively, it is possible to monitor an integrated value of the average luminance in frames, and to perform the special initialization when the integrated value exceeds a predetermined value. When the special initialization is performed, the integrated value is reset.

Moreover, in order to decrease further the influence of the background light emission in the special initialization, it is effective to control the interval between executions of the special initialization to be longer as a ratio of low gradation in display data is larger. It is because that the background light emission is conspicuous in a part of low gradation in an image. In this case too, the number M of frames is changed in accordance with the average value of the display data in plural frames.

It is possible to combine the control of changing the number M of frames as described above with a control of changing the number M of frames in accordance with temperature. A relationship between the number of sustain pulses and frequency of the special initialization is changed in accordance with temperature of a panel. In addition, it is possible to perform a control of changing the number M of frames in accordance with only temperature. Expansion of sustain discharge increases as the temperature of the panel increases. Namely, the surplus accumulated charge that is accumulated in the portions far from the discharge gap increases as the temperature increases, so the necessity of the special initialization increases. Therefore, it is effective to monitor temperature of an outer surface of the plasma display panel 1 or inside the same, and to set the interval between executions of the special initialization to a smaller value for higher temperature. Note that temperature at periphery of the plasma display panel 1 can be monitored. This is useful when using a plasma display panel 1 for a display of a pattern that has a tendency to cause uneven distribution of temperature in the screen.

(Frame Structure)

Each cell of the plasma display panel 1 is a binary light emission element, so a frame is displayed after being replaced with plural subframes that are binary images having luminance weight.

Figure 6A:
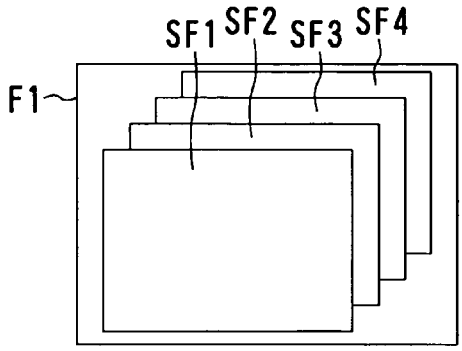
FIGS. 6(A) and 6(B) are diagrams showing a first example of a frame structure.
Figure 6B:
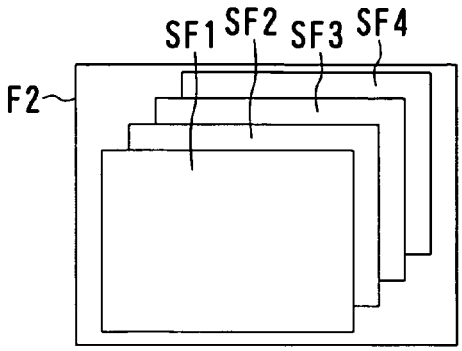

FIGS. 6(A) and 6(B) show a first example of a frame structure. In this example, the ordinary frame F1 includes four subframes SF1, SF2, SF3 and SF4 as shown in FIG. 6(A), and the special frame F2 also includes four subframes SF1, SF2, SF3 and SF4 as shown in FIG. 6(B). In other words, the subframe structure is common to the ordinary frame F1 and the special frame F2. Note that though the number of subframes in each frame is four in FIG. 6 for convenience of drawing, the number of subframes is typically 8-10 in a real drive.

Figure 7A:
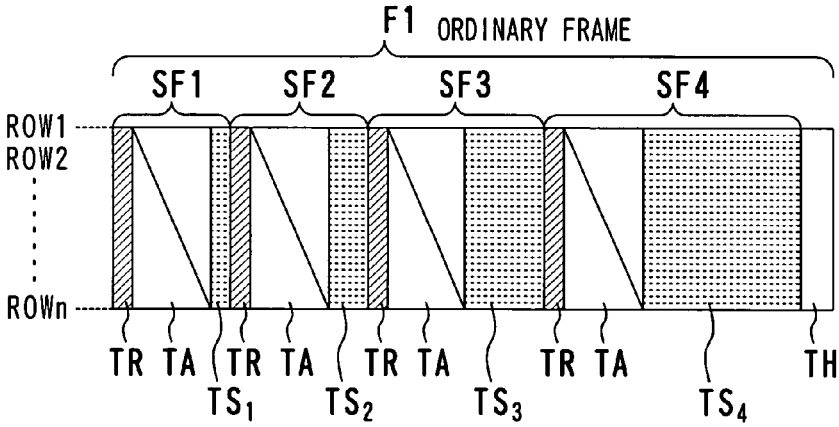
FIGS. 7(A) and 7(B) are diagrams showing assignment of periods to frames in the frame structure of the first example.
Figure 7B:
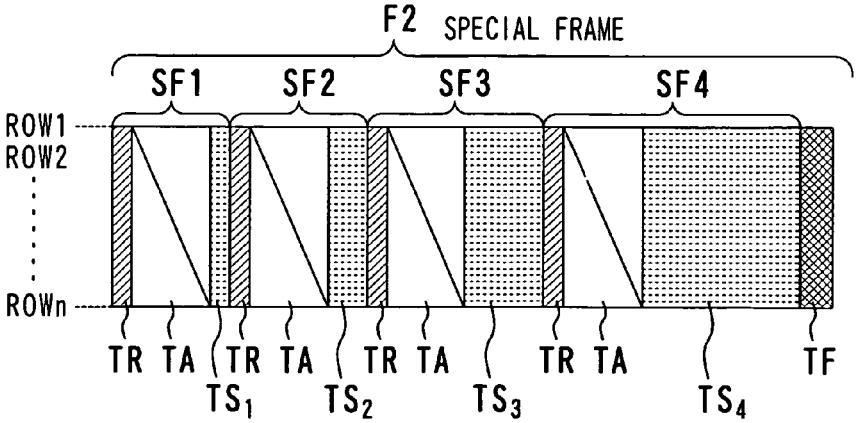

FIGS. 7(A) and 7(B) show assignment of periods to frames in the frame structure of the first example. Regardless of the ordinary frame F1 or the special frame F2, an initialization period TR for the initialization, an address period TA for the addressing and a sustain period $TS_j$ (j=1-4) for the lighting are assigned to each of the subframes SF1, SF2, SF3 and SF4. Lengths of the initialization period TR and the address period TA are constant regardless of a luminance weight, while a length of the display period $TS_j$ is larger as the luminance weight is larger.

As shown in FIG. 7(B), a special initialization period TF is assigned to the special frame F2. In addition, as shown in FIG. 7(A), a pause period TH having the same length as the special initialization period TF is assigned to the ordinary frame F1 for time adjustment. There are plural initialization periods TR per frame, while there is one special initialization period TF. Though the special initialization period TF is disposed at the end of the frame period that is assigned to the frame in the illustrated example, the special initialization period TF can be disposed at any position in the frame period. However, the three periods of each subframe must be sequential. It is allowed to dispose a special initialization period TF between a subframe and another subframe. The pause period TH is a period for stopping application of a voltage that changes a state of the cell.

Figure 8A:
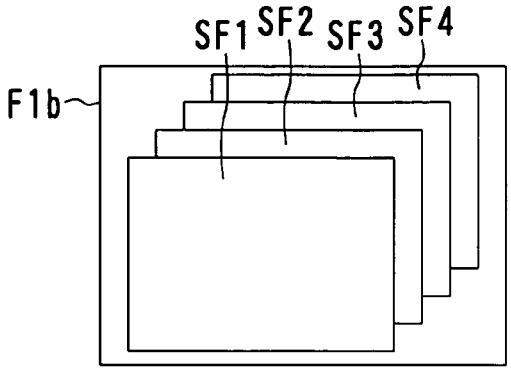
FIGS. 8(A) and 8(B) are diagrams showing a second example of the frame structure.
Figure 8B:
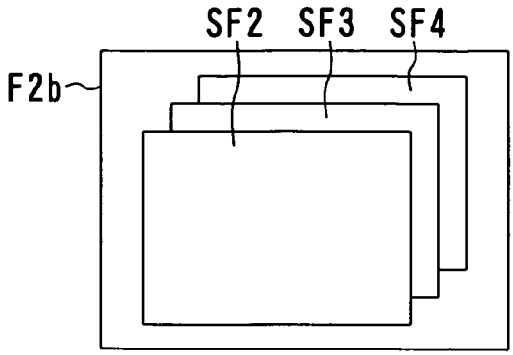

FIGS. 8(A) and 8(B) show a second example of the frame structure. In this example, an ordinary frame F1*b* includes four subframes SF1, SF2, SF3 and SF4 as shown in FIG. 8(A), and a special frame F2*b* includes three subframes SF2, SF3 and SF4 as shown in FIG. 8(B). Namely, the subframe structure is different between the ordinary frame F1*b* and the special frame F2*b*.

Figure 9A:
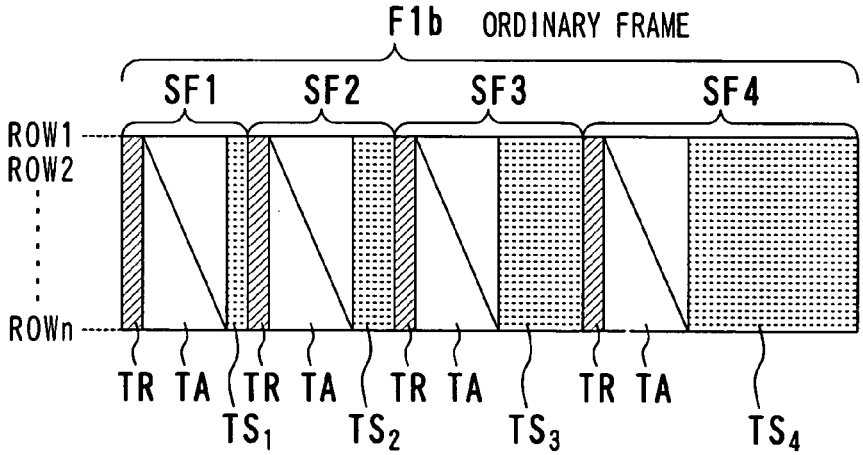
FIGS. 9(A) and 9(B) are diagrams showing assignment of periods to frames in the frame structure of the second example.
Figure 9B:
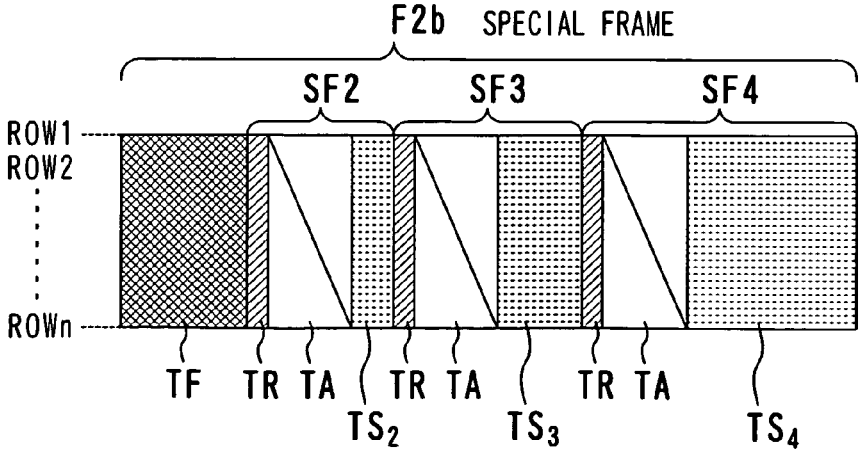

FIGS. 9(A) and 9(B) show assignment of periods to frames in the frame structure of the second example. Similarly to the first example described above, an initialization period TR, an address period TA and a sustain period $TS_j$ (j=1-4) are assigned to each of the subframes SF1, SF2, SF3 and SF4. Furthermore, as shown in FIG. 9(B), a special initialization period TF is assigned to the special frame F2*b*. Hereinafter, the sustain period is denoted by "TS" except for the case where it is necessary to distinguish four subframes SF1, SF2, SF3 and SF4 from each other.

Here, when gradation level of light emission that accompanies the special initialization is denoted by p, if the subframe structure of the special frame F2*b* is the same as the subframe structure of the ordinary frame, the gradation level in a display of the special frame F2*b* is higher than a normal gradation level of the display data by the level p. Therefore, the special frame F2*b* is displayed in accordance with a result of operation of subtracting p from the gradation level of the display data, so that a display error is reduced. If the result of the subtraction becomes negative value, the display is not performed. Though a display error occurs in the cell having a negative value of the subtraction result, the influence thereof can be reduced by distributing the error to surrounding cells by a method of error diffusion or by correcting the error in the subsequent frame.

When performing the subtraction of the level p, luminance of the maximum gradation level in the special frame F2*b* becomes lower than luminance of the maximum gradation level in the ordinary frame F1*b* by the level p. Therefore, the number of sustain pulses in the special frame F2*b* can be smaller than the number of sustain pulses in the ordinary frame F1*b*. Note that if the number of sustain pulses in a frame is adjusted in accordance with the display ratio, the number of sustain pulses in the special frame F2*b* can be smaller than the number of sustain pulses in the ordinary frame F1*b* that has the same display ratio as the special frame F2*b*.

When the number of sustain pulses in the special frame F2*b* is set to a value smaller than the number of sustain pulses in the ordinary frame F1*b*, time corresponding to the difference between the number of pulses can be assigned to the special initialization. It is not necessary to provide a pause period in the ordinary frame F1*b*. If the difference of the number of pulses is close to the number of sustain pulses of the subframe SF1 having the minimum weight, the initialization period TR, the address period TA and the sustain period $TS_1$ to be assigned to the subframe SF1 can be replaced with the special initialization period TF as shown in FIG. 9.

(Drive Waveform)

Figure 10:
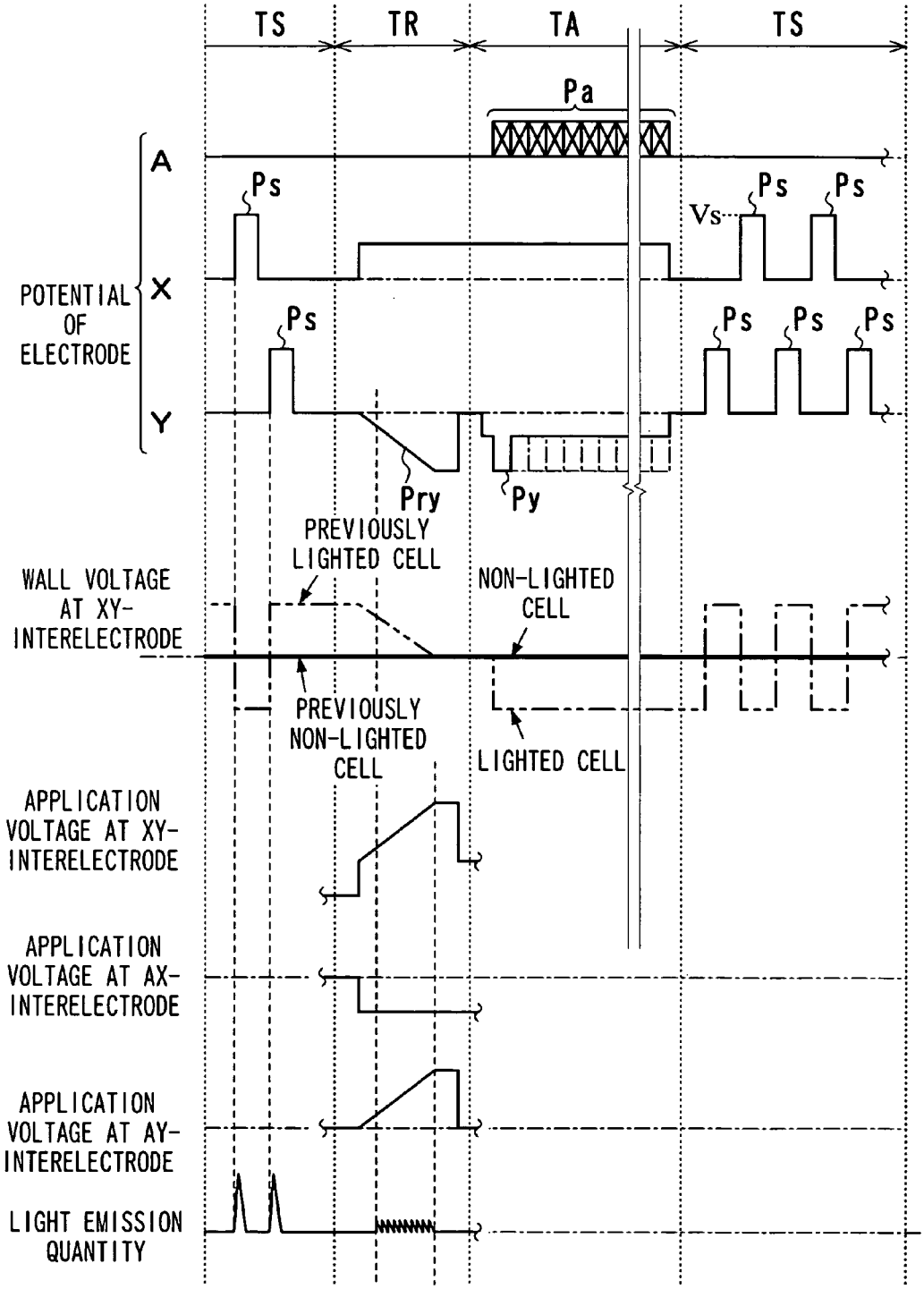
FIG. 10 is a diagram showing drive waveforms for a subframe.

FIG. 10 shows drive waveforms for a subframe. As described above, a drive period of one subframe includes an initialization period TR, an address period TA and a sustain period TS.

In the initialization period TR, in order to prevent the background light emission color from being a chromatic color, the initialization is performed by discharge except the micro discharge in which the address electrode A covered with the fluorescent material becomes a cathode. The initialization means to eliminate substantially a difference of wall voltage between a cell that was lighted in the immediately preceding sustain period TS (that is called a previously lighted cell) and a cell that was not lighted in the immediately preceding sustain period TS (that is called a previously non-lighted cell), namely to cancel the binary setting of the wall charge quantity in the screen. Here, it is supposed that at the start point of the initialization period TR, wall voltage having the positive polarity is generated at the XY-interelectrode of the previously lighted cell, and wall voltage at the XY-interelectrode of the previously non-lighted cell is zero.

In the example shown in FIG. 10, a ramp waveform pulse Pry having the negative polarity is applied to the display electrode Y in the initialization period TR. The application of a pulse to an electrode means to bias the electrode temporarily. The application of the ramp waveform pulse Pry causes micro discharge at the XY-interelectrode of the previously lighted cell, in which the display electrode X becomes an anode, and wall voltage at the XY-interelectrode decreases gradually to be zero. Though a ramp voltage is applied to the AY-interelectrode too by the application of the ramp waveform pulse Pry, this ramp waveform voltage is a voltage having the polarity such that the address electrode A becomes an anode, which does not generate micro discharge in which the address electrode A becomes a cathode.

During the address period TA, wall charge necessary for sustaining is formed in lighting cells (cells to be energized), and non-lighted cells (cell to be not energized) are maintained in the state without wall charge. All the display electrodes Y are biased to predetermined potential while a scan pulse Py is applied to one display electrode Y that corresponds to a selected row every row selection period (scan period for one row). At the same time as this row selection, an address pulse Pa is applied only to the address electrode A that corresponds to the selected cell to generate the address discharge. Namely, potential of the address electrode A is controlled in a binary manner in accordance with display data of the selected row. In the selected cell, discharge is generated at the AY-interelectrode, which triggers the surface discharge at the XY-interelectrode. These sequential discharge is the address discharge.

During the sustain period TS, a sustain pulse Ps having a rectangular waveform at amplitude Vs is applied to the display electrode Y and the display electrode X alternately. Thus, a pulse train having alternating polarities is applied to the XY-interelectrode. The application of the sustain pulse Ps causes surface discharge in the lighted cell. The number of application times of the sustain pulse Ps corresponds to the weight of the subframe.

Figure 11:
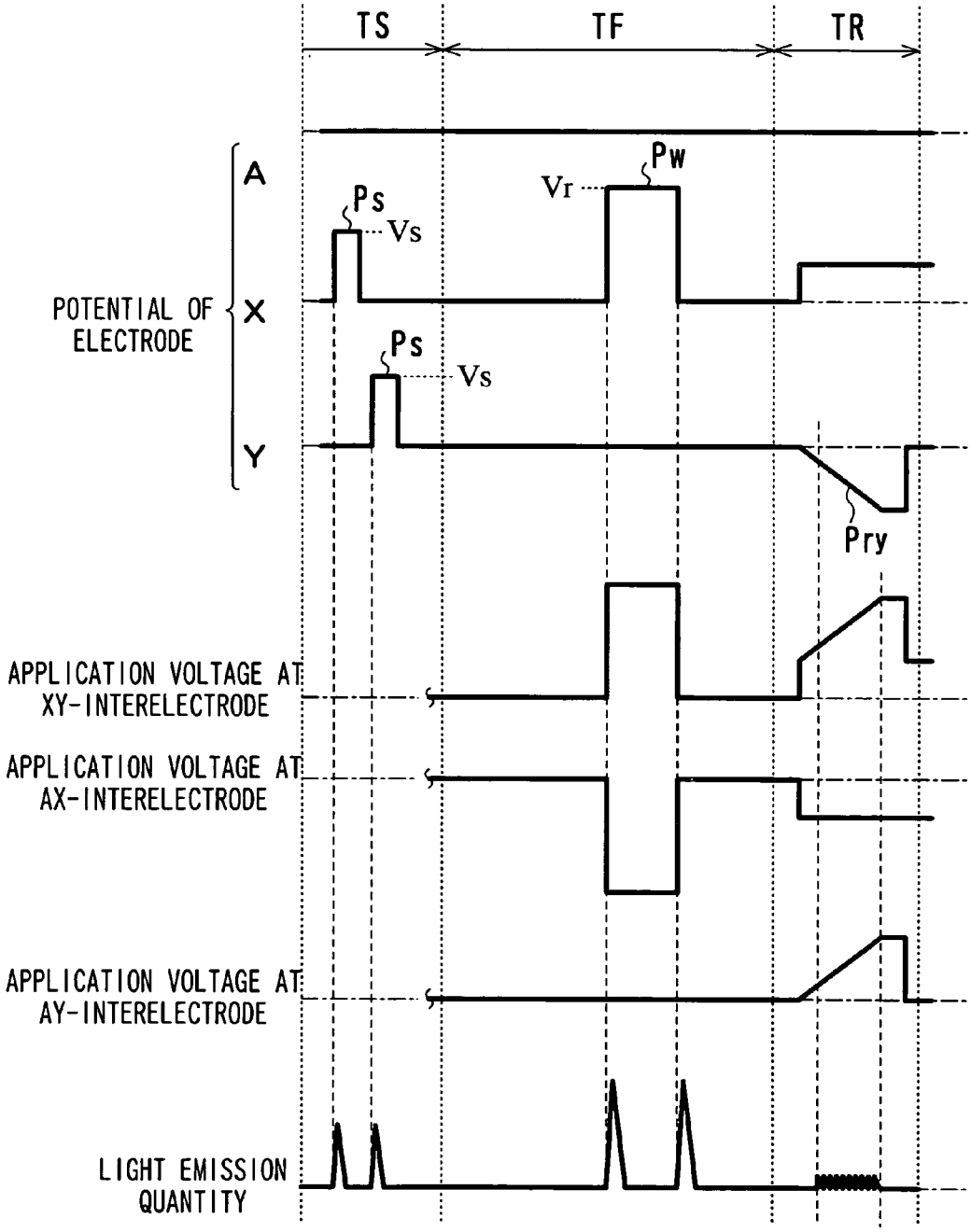
FIG. 11 is a diagram showing a first example of the drive waveform for the special initialization.

FIG. 11 shows a first example of the drive waveform for the special initialization. A rectangular waveform pulse Pw having the positive polarity is applied to the display electrode X during the special initialization period TF. The amplitude Vr of the rectangular waveform pulse Pw is sufficiently larger than the amplitude Vs of the sustain pulse Ps. The application of the rectangular waveform pulse Pw causes discharge sufficiently stronger than the micro discharge in the initialization in every cell, so that large quantity of wall charge is formed in every cell. The large quantity of wall charge causes self-erasing discharge that erases the wall charge responding to the end of application of the rectangular waveform pulse Pw. It is desirable to generate counter discharge positively in the special initialization. It is because that the counter discharge can spread more easily to the periphery of the cell than the surface discharge. In this example, the counter discharge is generated in the AX-interelectrode, in which the address electrode A becomes a cathode.

Figure 12:
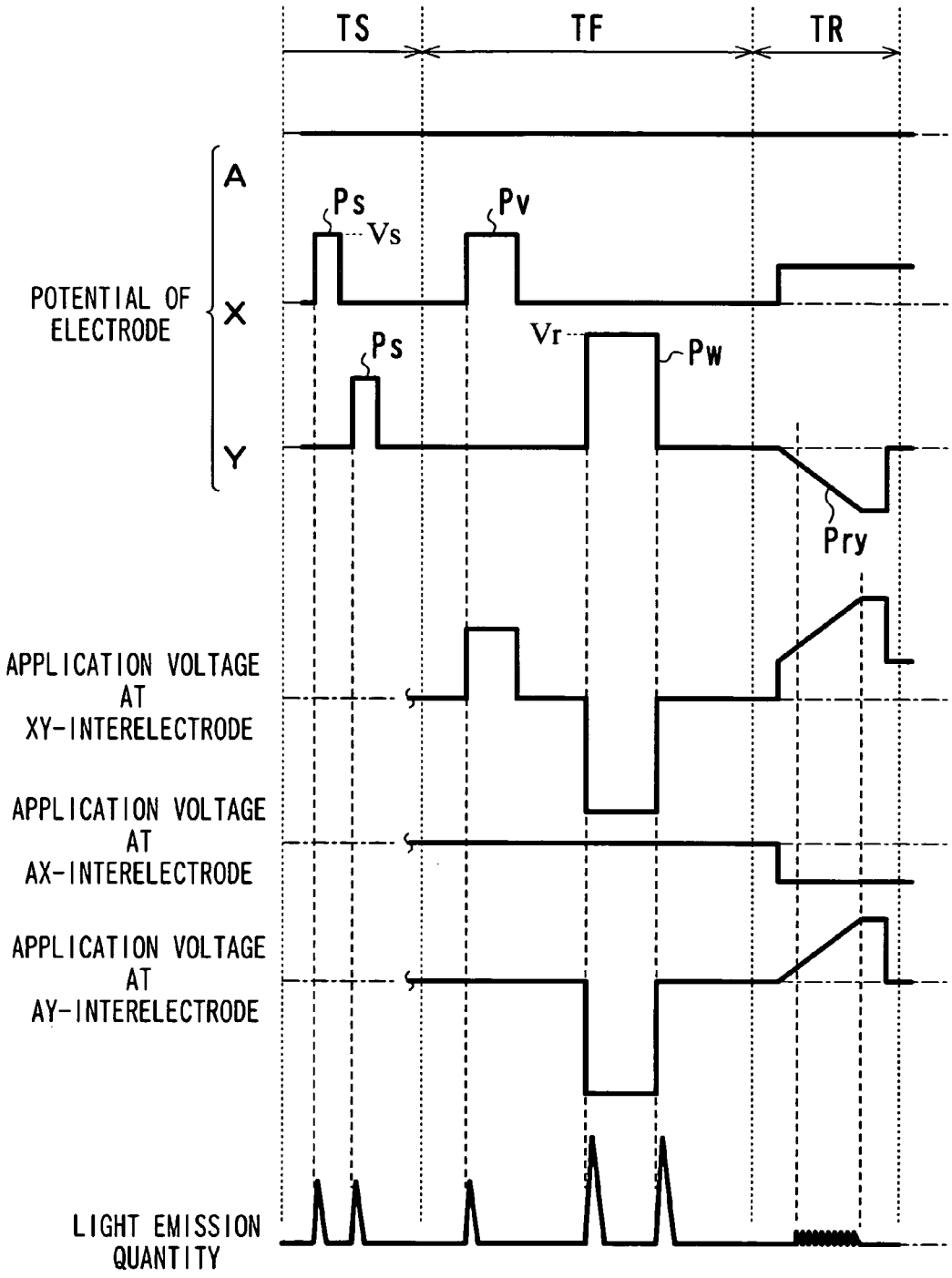
FIG. 12 is a diagram showing a second example of the drive waveform for the special initialization.

FIG. 12 shows a second example of the drive waveform for the special initialization. The rectangular waveform pulse Pw having large amplitude is applied to the display electrode Y. In order to reverse a polarity of the wall voltage before that, a rectangular waveform pulse Pv having amplitude Vs is applied to the display electrode X. The application of the rectangular waveform pulse Pv causes discharge in previously lighted cells. If the sustain pulse Ps is applied to the display electrode X at the end of the sustain period Ts, the application of the rectangular waveform pulse Pv is not necessary. Whether or not the application of the rectangular waveform pulse Pv is necessary depends on selection of the drive waveform of the sustain period Ts.

Figure 13:
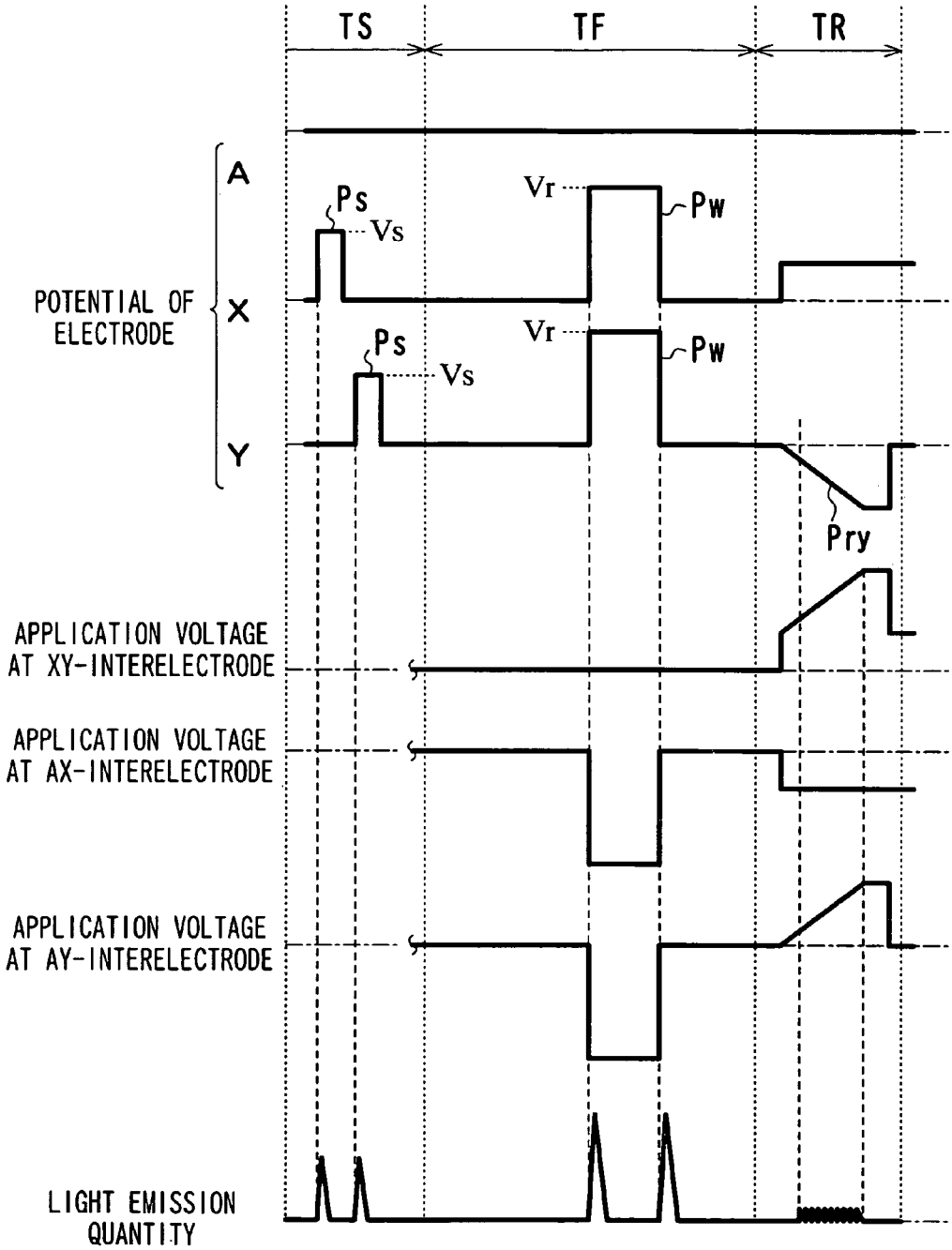
FIG. 13 is a diagram showing a third example of the drive waveform for the special initialization.

FIG. 13 shows a third example of the drive waveform for the special initialization. The rectangular waveform pulse Pw is applied to the display electrode X and the display electrode Y simultaneously. In this case, discharge is not generated at the XY-interelectrode in every cell, but sufficiently strong discharge of counter discharge form is generated at the AX-interelectrode and the AY-interelectrode in every cell. The strong discharge generates large quantity of wall charge, which causes self-erasing discharge responding to the end of the application of the rectangular waveform pulse Pw.

Figure 14:
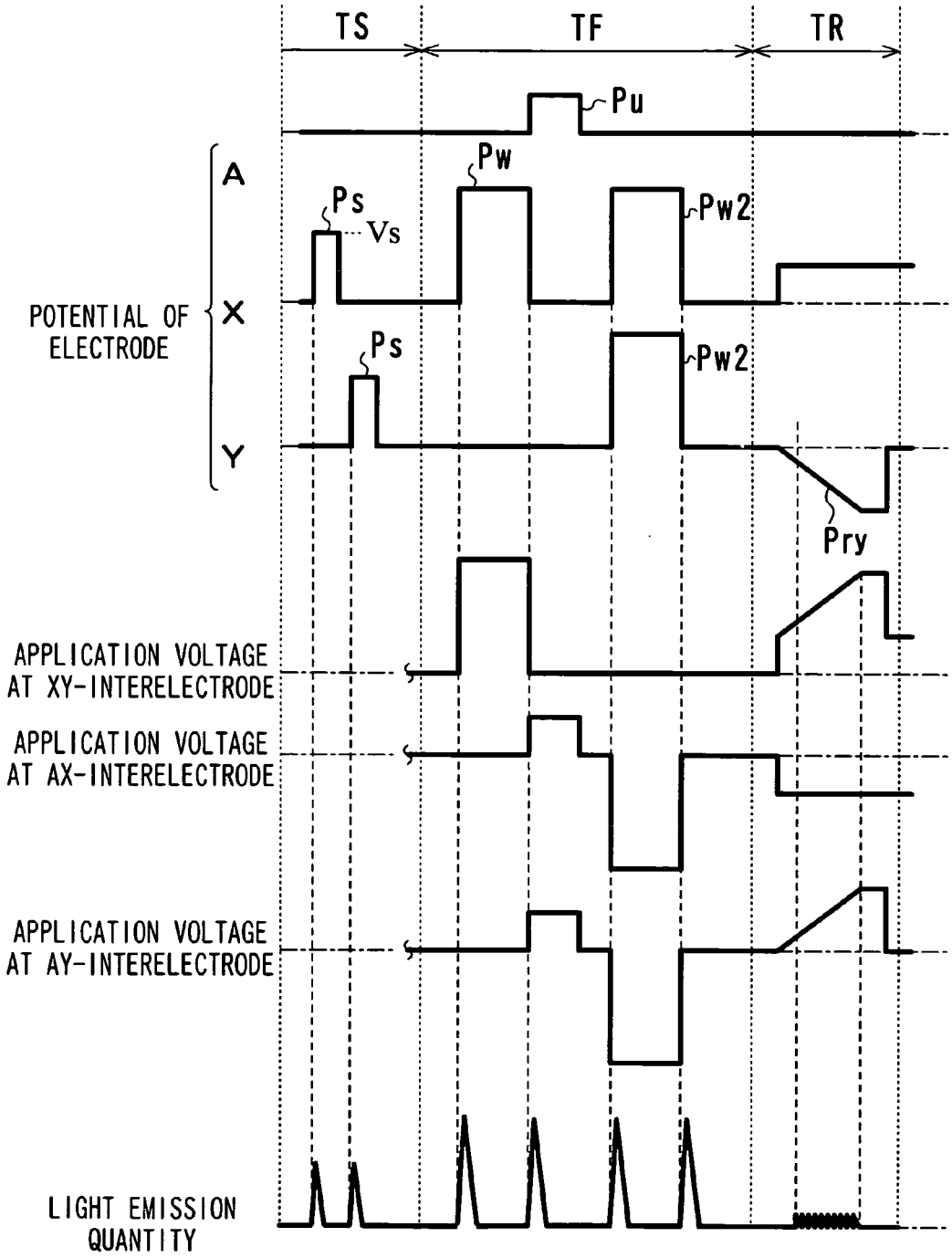
FIG. 14 is a diagram showing a fourth example of the drive waveform for the special initialization.

FIG. 14 shows a fourth example of the drive waveform for the special initialization. The rectangular waveform pulse Pw is applied to the display electrode X, then a rectangular waveform pulse Pu is applied to the address electrode A, and the rectangular waveform pulse Pw2 is applied to the display electrode X and the display electrode Y simultaneously. In this example, a combination of the self-erasing discharge in the surface discharge form and the self-erasing discharge in the counter discharge form can erase the wall voltage in the cell more completely.

Figure 15:
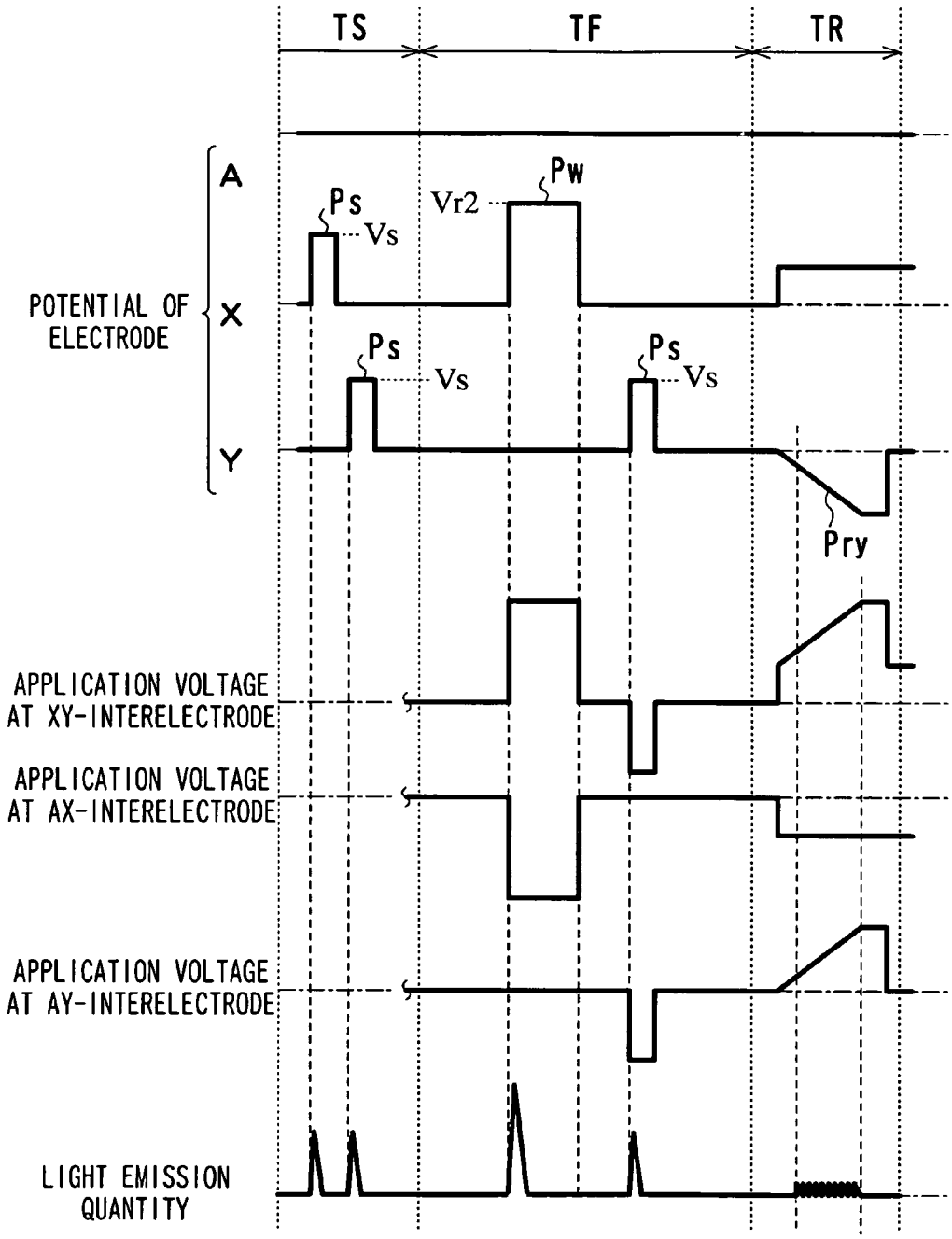
FIG. 15 is a diagram showing a fifth example of the drive waveform for the special initialization.

FIG. 15 shows a fifth example of the drive waveform for the special initialization. During the special initialization period TF, a rectangular waveform pulse Pw having the positive polarity is applied to the display electrode X, and after that the sustain pulse Ps is applied to the display electrode Y. Amplitude Vr2 of the rectangular waveform pulse Pw2 is sufficiently larger than the amplitude Vs of the sustain pulse Ps. Application of the rectangular waveform pulse Pw causes discharge at the XY-interelectrode and the AX-interelectrode in every cell, which is sufficiently larger than the micro discharge in the initialization. At this time, the address electrode A becomes a cathode. The strong discharge generates large quantity of wall charge in every cell. The large quantity of wall charge causes the self-erasing discharge responding to the end of the application of the rectangular waveform pulse Pw. When the sustain pulse Ps is applied, a state of vicinity of the discharge gap in each cell at the end of the special initialization becomes similar to the state at the end of the sustain period TS. This improves stability of the drive.

Note that it is possible to insert a dummy subframe for lighting every cell (namely a set of the initialization period, the address period and the sustain period) at the end of the special initialization period, so that the state at the end of the special initialization becomes close more precisely to the state at the end of the sustain period TS. Instead of the insertion of the dummy subframe, a plurality of sustain pulses may be applied at the end of the special initialization period. The sustain pulse in this case is preferably a pulse that is common to the sustain pulse Ps that is applied to the sustain period TS. However, if amplitude is common, there is not a large difference of effect even if a pulse width is different.

Figure 16:
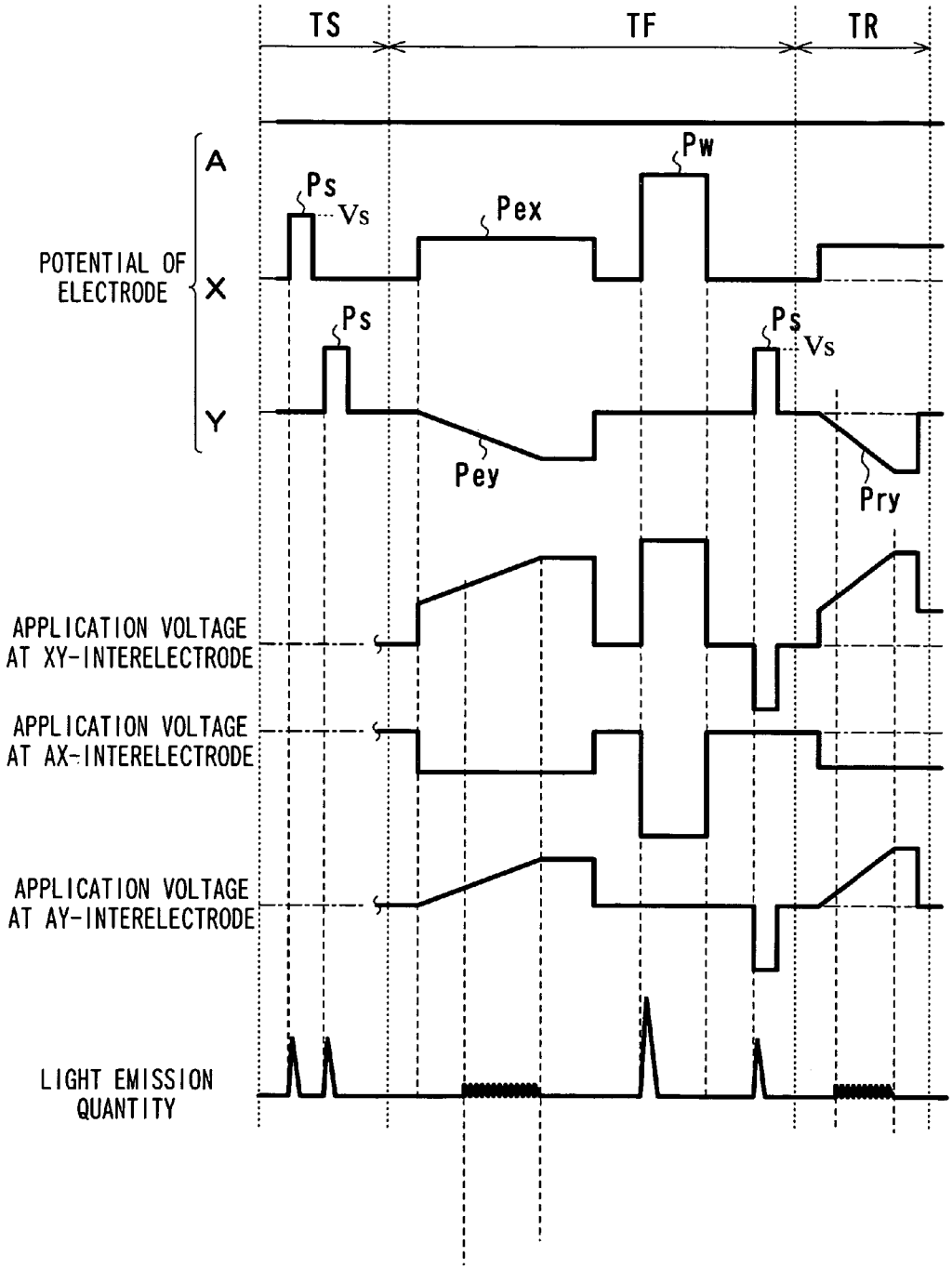
FIG. 16 is a diagram showing a sixth example of the drive waveform for the special initialization.

FIG. 16 shows a sixth example of the drive waveform for the special initialization. This example is a variation of the fifth example. In this example, before the application of the rectangular waveform pulse Pw, wall charge remaining in the previously lighted cell is erased. In the drive form where an erasing pulse is not applied at the end of the sustain period TS, light emission quantity of discharge accompanying the application of the rectangular waveform pulse Pw is different between the previously lighted cell and the previously non-lighted cell. This means that the luminance weight of the immediately preceding subframe varies, which is not good. Therefore, the erasing pulse is applied at the start of the special initialization period TF. The erasing pulse in this example includes a ramp waveform pulse Pey that has the negative polarity and is applied to the display electrode Y and a rectangular waveform pulse Pex that has the positive polarity and is applied to the display electrode X. This erasing pulse causes the micro discharge at the XY-interelectrode, which erases the remaining wall charge. Though the light emission quantity of the micro discharge is also different between the previously lighted cell and the previously non-lighted cell, the absolute value of the light emission quantity is smaller than the discharge due to the rectangular waveform pulse Pw, so there is little problem about the difference of the light emission quantity.

In the first through sixth examples described above, there is no need that the drive waveform of the special initialization period is always constant, but the waveform can be changed in accordance with the change of the frequency of the special initialization. In addition, it is possible to divide the screen into plural blocks, and to optimize the waveform for each block.

Figure 17:
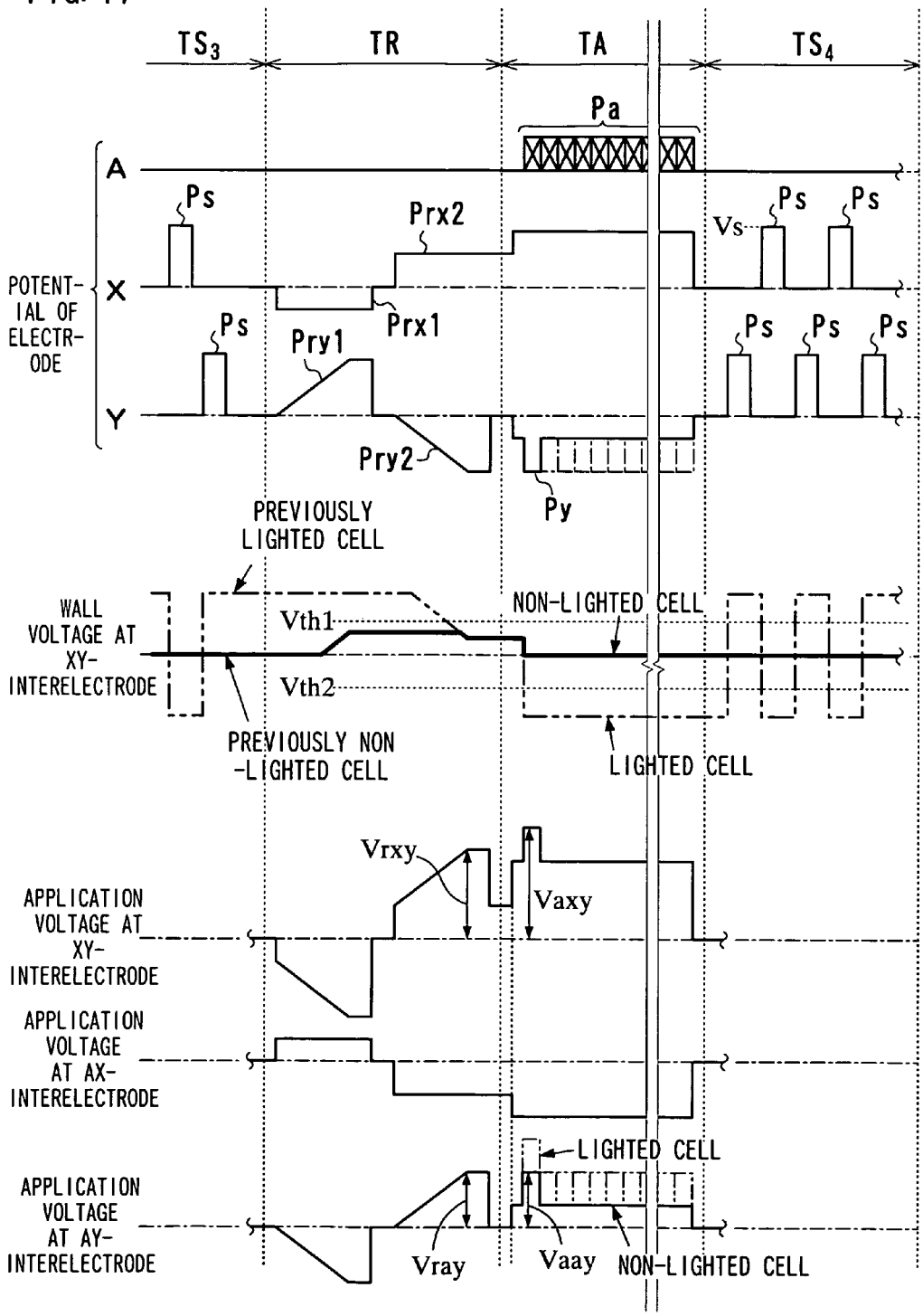
FIG. 17 is a diagram showing another example of the drive waveform for the subframe.

FIG. 17 shows another example of the drive waveform for the subframe. During the initialization period TR, micro discharge must not be generated in which the address electrode A becomes a cathode, though it is allowable to apply an obtuse waveform voltage to the cell, in which potential of the address electrode A becomes lower than potential of other electrodes. In FIG. 17, the ramp waveform pulse Pry1 having the positive polarity is applied to the display electrode Y, so a ramp voltage of a polarity to be noted is applied to the AY-interelectrode. However, the micro discharge in which the address electrode A becomes a cathode is not generated only by selecting the amplitude (final voltage) of the ramp waveform pulse Pry1 so that the cell voltage at the AY-interelectrode does not exceed the discharge start voltage.

The drive waveform in the initialization as shown in FIG. 17 is suitable for realizing the binary setting of the wall charge for deciding light or non-light not by whether or not address discharge is necessary but by intensity of the address discharge and for performing the write form addressing. The method of realizing the binary setting by the intensity of the address discharge is disclosed in Japanese unexamined patent publication No. 2000-155556. A general outline of this method is as follows. When performing the write form addressing, wall voltage at the XY-interelectrode is set to a value within a non-lighting range where display discharge cannot be generated as the addressing preprocess. The non-lighting range is a range where the cell voltage does not exceed the discharge start voltage even if the sustain voltage having the same polarity as the wall voltage is applied. The lower limit of the non-lighting range is the threshold level Vth2 of the negative polarity, and the upper limit thereof is the threshold level Vth1 on the positive polarity side. In the addressing process, strong address discharge is generated in the selected cell (lighted cell in the case of the write form), and the wall voltage Vw is changed to a value within the lighting range where display discharge is generated at the polarity opposite to the previous discharge. On the contrary, weak address discharge is generated in the non-selected cell (non-lighted cell) for priming. At this moment, wall voltage of the non-lighted cell is changed from the immediately preceding value in the address discharge to a value lower than the same (zero in the illustrated example).

An operation of the lighted cell in the case where intensity of the address discharge realizes the binary setting is the same as that in the case where the binary setting is determined by whether or not the address discharge is necessary. Strong address discharge forms sufficient wall charge for display discharge. The initialization of this lighted cell is performed by the ramp waveform pulse Pry2 that has the negative polarity and is applied to the display electrode Y after the ramp waveform pulse Pry1. It is not necessary to generate discharge by the first ramp waveform pulse Pry1. Namely, there is no problem about the lighted cell if the ramp waveform pulse Pry1 having the polarity in which the address electrode A becomes a cathode is applied or if it is not applied.

However, the ramp waveform pulse Pry1 is essential in the non-lighted cell. The address discharge is generated in the non-lighted cell too, though the intensity is small, so the wall voltage is changed after the addressing. Therefore, in the initialization period TR, the wall voltage that has changed in the previous addressing must be changed to be the original value. The display discharge is not generated in the non-lighted cell, so the non-lighted cell enters the initialization period TR of the next subframe in the state after the address discharge as the previously non-lighted cell. One of the characteristics of the method of realizing the binary setting by the intensity of the address discharge is that a polarity of wall voltage at the address discharge is the same as a polarity of the obtuse waveform pulse for generating micro discharge immediately preceding the address period (a second ramp waveform pulse Pry2 in this example, which is called a compensation obtuse waveform pulse hereinafter), and the interelectrode applied voltage Vaxy at the address discharge is larger than the final value Vrxy of the voltage that is applied to the interelectrode for the micro discharge. Therefore, if weak address discharge is generated and even if only the compensation obtuse waveform pulse is generated in the initialization period TR without display discharge after that, discharge is not generated. Namely, initialization of the previously non-lighted cell cannot be performed.

In order to initialize the non-lighted cell that has generated weak address discharge, it is necessary to apply another obtuse waveform pulse except for the compensation obtuse waveform pulse. In order to increase wall voltage that has been decreased by the weak address discharge, it is necessary to generate micro discharge having a polarity opposite to the weak address discharge before generating the micro discharge by the compensation obtuse waveform pulse. However, micro discharge in which the address electrode A becomes a cathode must not be generated, so the weak address discharge must not be discharge in which the address electrode A becomes an anode. Namely, the weak address discharge is preferably only discharge at the XY-interelectrode. Thus, a first ramp waveform pulse Pry1 that generates only the discharge at the XY-interelectrode can initialize the previously non-lighted cell. Such an operation can be realized by the waveform as shown in FIG. 17. The application of the first ramp waveform pulse Pry1 increases the wall voltage a little redundantly, and the second ramp waveform pulse Pry2 (the compensation obtuse waveform pulse) can adjust the wall voltage quantity.

The interelectrode where the weak address discharge is generated is determined by a relationship between the final voltage at each interelectrode when the compensation obtuse waveform pulse is applied and the applied voltage at each interelectrode when the weak address discharge is generated. The interelectrode where discharge is generated by the compensation obtuse waveform pulse is the interelectrode where the weak address discharge can be generated. Considering the voltage with respect to a polarity of the compensation obtuse waveform voltage at each interelectrode, if the applied voltages Vaxy and Vaay of the weak address discharge at a certain interelectrode are higher than the final values Vrxy and Vray of the compensation obtuse waveform voltage, weak address discharge is generated at the interelectrode.

Therefore, in order to generate the weak address discharge only at the XY-interelectrode, it is necessary to set the applied voltage Vaxy at the XY-interelectrode when the weak address discharge is generated to a value higher than the final value Vrxy of the compensation obtuse waveform voltage at the XY-interelectrode and to set the applied voltage at the AY-interelectrode when the weak address discharge is generated (during the non-selected period) in the non-lighted cell to a value smaller than or equal to a final value Vray of the compensation obtuse waveform voltage at the AY-interelectrode. In this case, the compensation obtuse waveform discharge is generated at the XY-interelectrode and the AY-interelectrode.

Note that it is ideal that the weak address discharge is not generated at all at the AY-interelectrode from a viewpoint of the background light emission. However, this form has a disadvantage that scan voltage becomes low, so that high address potential is necessary for generating strong address discharge. Therefore, there is also a reason for the form in which very weak address discharge is generated at the AY-interelectrode. The characteristic of the drive waveform in this form is that the applied voltage at the AY-interelectrode when the weak address discharge is generated (during the non-selected period) is little higher than the final value of the compensation obtuse waveform voltage at the AY-interelectrode.

Figure 18:
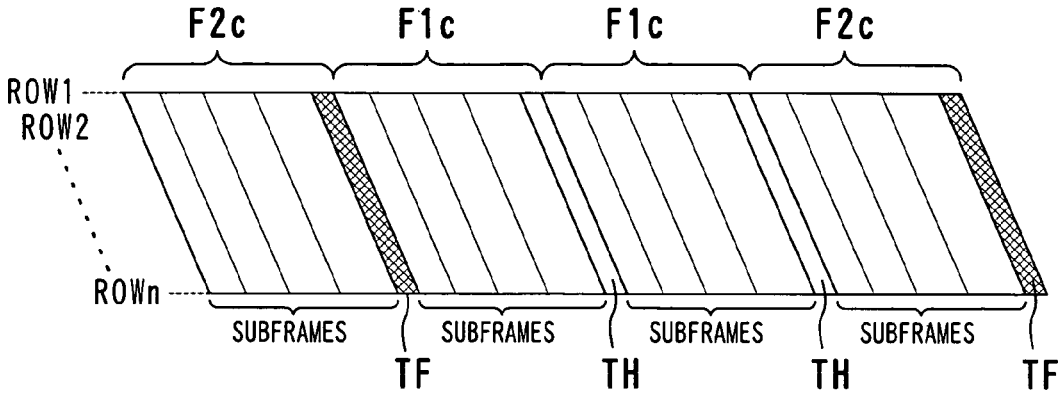
FIG. 18 is a diagram showing another display form.

The driving method according to the present invention that performs the special initialization at an appropriate frequency as described above can be applied not only to the display form in which the addressing and the sustaining (also called displaying) are separated from each other on a timescale but also to the display form in which sustaining is started sequentially from the row that finishes the addressing as shown in FIG. 18. In FIG. 18, the frame train includes a special frame F2*c* and an ordinary frame F1*c*. The special initialization period TF is assigned to the special frame F2*c*, and the pause period TH is assigned to the ordinary frame F1*c*.

The present invention is useful for improving contrast of a display by a plasma display panel and stabilizing a display, and also contributes to improvement of background light emission color.

While the presently preferred embodiments of the present invention have been shown and described, it will be understood that the present invention is not limited thereto, and that various changes and modifications may be made by those skilled in the art without departing from the scope of the invention as set forth in the appended claims.

What is claimed is:

1. A method for driving an AC type plasma display panel having a screen including a plurality of cells, each cell being defined at a respective intersection of a pair of first and second display electrodes arranged in a row direction and an address electrode arranged in a column direction, the method comprising:

performing initialization at least once for each frame so as to clear binary setting of wall charge quantity in the screen by applying a ramp waveform pulse between the first and second display electrodes; and performing special initialization at frequency of once for every M frames, where M is two or more, so as to erase unnecessary wall charges in the screen by applying at least one of a first rectangular waveform pulse between the first display electrodes and the address electrode, and a second rectangular waveform pulse between the second display electrodes and the address electrode, the first rectangular waveform pulse and the second rectangular waveform pulse being applied with a polarity in which the address electrode becomes a cathode, causing a discharge that is stronger than a discharge in the initialization, between the at least one of the first display electrodes and the address electrode, and the second display electrodes and the address electrode, respectively.

* * * * *

UNITED STATES PATENT AND TRADEMARK OFFICE

CERTIFICATE OF CORRECTION

PATENT NO. : 7,642,991 B2
APPLICATION NO. : 10/869852
DATED : January 5, 2010
INVENTOR(S) : Yasunobu Hashimoto et al.

It is certified that error appears in the above-identified patent and that said Letters Patent is hereby corrected as shown below:

Column 14, Line 13, after "clear" insert --a--.

Signed and Sealed this

Thirtieth Day of March, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,642,991 B2
APPLICATION NO. : 10/869852
DATED : January 5, 2010
INVENTOR(S) : Hashimoto et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1433 days.

Signed and Sealed this

Sixteenth Day of November, 2010

David J. Kappos

David J. Kappos
*Director of the United States Patent and Trademark Office*